United States Patent [19]

Dozier

[11] Patent Number: 4,921,452

[45] Date of Patent: May 1, 1990

[54] BREAKAWAY HERMETICALLY SEALED ELECTRICAL TERMINAL

[76] Inventor: Hilliard Dozier, Stubbs Mill Rd., Lebanon, Ohio 45036

[21] Appl. No.: 335,711

[22] Filed: Apr. 10, 1989

Related U.S. Application Data

[63] Continuation-in-part of Ser. No. 235,027, Aug. 22, 1988, Pat. No. 4,830,630.

[51] Int. Cl.[5] ..... H01R 13/68

[52] U.S. Cl. ..... 439/622; 174/152 GM; 337/1; 439/736

[58] Field of Search ..... 439/621, 622, 736, 935; 174/152 GM; 337/1, 401, 405, 416, 417

[56] References Cited

U.S. PATENT DOCUMENTS

| | | | |
|---|---|---|---|
| 3,160,460 | 12/1964 | Wyzenbeek | 439/736 |
| 4,461,925 | 7/1984 | Bowsky et al. | 439/736 |
| 4,480,151 | 10/1984 | Dozier | 439/736 |
| 4,609,774 | 9/1986 | LeMieux et al. | 439/621 |
| 4,739,551 | 4/1988 | Bowsky et al. | 174/152 GM |

*Primary Examiner*—Gary F. Paumen

*Attorney, Agent, or Firm*—Frost & Jacobs

[57] ABSTRACT

An hermetically sealed terminal construction having one or more terminal pin assemblies wherein inner and outer pin parts are interconnected by a fuse link surrounded by a protective capsule defining an expansion cavity, the capsule having a vent port closed by a blow-out plug, the terminal pin assemblies extending through and being hermetically sealed to sleeve forming parts of the supporting base, including a dielectric sealing member which covers the protective capsules, the blow-out plugs and contiguous portions of the adjoining pin parts, the blow-out plugs being adapted to be expelled from the protective capsules upon the build-up of pressure within the capsules caused by disintegration of the fuse links, thereby cutting off the flow of current through the terminal while maintaining the integrity of the hermetical seals by means of which the terminal pin assemblies are mounted to the terminal base.

18 Claims, 4 Drawing Sheets

BREAKAWAY HERMETICALLY SEALED ELECTRICAL TERMINAL

This is a continuation in part of U.S. patent application Ser. No. 07/235,027 filed Aug. 22, 1988 and entitled Hermetically Sealed Electrical Terminal.

This invention relates to electrical terminals and more particularly to an hermetically sealed electrical terminal of the type wherein one or more conductor pins project through sleeve-like openings in the body of the terminal and are secured to the terminal by means of seals which hermetically seal the pins against the exchange of atmosphere between the opposite sides of the terminal body.

BACKGROUND OF THE INVENTION

Hermetically sealed terminals have been widely used for many years in refrigeration equipment, wherein an electrical connection is made with component mounted within a sealed receptacle. In the case of refrigeration headers, the motor-compressor units are hermetically sealed and are normally located outside the building they are intended to heat or cool. Normally these units are very reliable and operate without difficulty over many years of service and, in general, are quite safe when installed, serviced and inspected by trained professional personnel. Even under these conditions, however, there is an occasional dangerous explosive venting of the motor-compressor receptacle through the electric terminal, the terminal seals being arced-away or shattered by explosive forces generated within the sealed system. If the explosive venting occurs when no one is close to the system, the resulting fumes, odor and/or flames, which are rapidly propelled through the openings in the terminal body, would be of concern, but not necessarily injurious. This is not always the case, however, and numerous injuries have resulted from ruptured terminals.

While various safety devices have hitherto been utilized to safeguard against dangerous venting of the refrigeration gases and oil, including the provision of thermal protectors which will shut down the motor-compressor unit if a predetermined internal circuit temperature is reached, none of these devices has proven to be wholly satisfactory. For example, a locked rotor will cause currents of approximately 5-6 times the rated load current of the unit to flow through the terminals to the motor winding. Because it is necessary for the external branch circuit fuses or circuit breakers to have a considerable time delay before they interrupt the current to the compressor (which delay is required for normal starting), these fuses and breakers do not rapidly trip to shut off the current to the unit. As a further complication, service personnel and homeowners sometimes attempt to restart the motor-compressor unit by installing slow-blow fuses of much higher amperage than recommended, or use no fuses at all—just copper bars or alligator clips for supplying current directly to the unit.

If during attempted startup the motor-compressor unit is in a major fault condition, any of the foregoing conditions could result in very dangerous explosive venting of the contents of the sealed unit and at the same time provide considerable electric power for ignition of the venting materials.

Various other expedients have been proposed to overcome the problem, but none has been totally satisfactory. For example, various types of temperature responsive circuit interrupters have been proposed for incorporation in the terminal itself. One such device utilizes thermally sensitive pellets which act to release a spring-bias contact as the pellet melts. While effective, the current interrupting action is too slow in operation due to the relatively large mass of material which must be melted and caused to flow before the gap between the conductive members is at the maximum. While efforts have been made to enhance the sensitivity of such devices and provide fast-tripping action, such efforts have not been totally successful in shutting down the motor-compressor before blow-outs occur.

In contrast to the foregoing, the aforementioned copending application Ser. No. 07/235,027 provides a terminal construction which provides for substantially instantaneous cut-off of current when a predetermined current induced temperature level is reached, including a unique pin construction whereby Portions of the terminal pins are physically separated from the remainder of the terminals while maintaining the integrity of the hermetic seals.

An analysis of past failures of hermetically sealed terminals leads to the conclusion that undesirable venting or blow-out of the terminals occurs because of several factors:

(1) Very high currents passing through the terminal due to major shorts or contamination.

(2) The high currents and/or contamination cause very high temperatures and arcing over the internal surfaces of the terminal.

(3) In the case of terminals utilizing glass-to-metal seals, the very high current induced temperatures cause the glass seals to become more conductive and thereby accelerate the temperature build up until the physical strength and integrity of the seal is explosively lost.

(4) In the case of so-called "soft-seal" terminals wherein the terminal pins are sealed using various distortable dielectrical materials, the seal is gradually arced away until failure results.

In order to prevent these potentially catastrophic failures, the subject application teaches a terminal construction wherein the terminal pins are formed by inner and outer pin parts interconnected by a high-temperature, high-current fuse link formed from a silver alloy which will melt and/or vaporize when heated to a predetermined temperature, thereby rapidly breaking the electrical connection between the inner and outer pin parts. Preferably, the fuse link are formed from a silver alloy having a melting point in the range of 1100°-1450° F., although the melting point and current carrying capacity of the fuse link will be chosen in accordance with the electrical characteristics of the device being operated. For example, in the case of a refrigeration header, the fuse link will be sized to carry current equal to the locked rotor amperage of the compressor for a continuous time period in excess of three minutes and a current of two times the locked rotor amperage for approximately two to six seconds The fuse link and the adjacent ends of the inner and outer terminal pins are surrounded by a protective capsule which provides an air space or cavity surrounding the fuse link, the cavity providing space for the melted or vaporized fuse link material to migrate, thereby assuring clean separation of the pin parts. In cases where a major fault occurs, as where very high short circuit currents are encountered, the vaporization of the fuse material is extremely rapid and very high internal capsule pressures will result. To assure rapid current cut-off, the capsule is designed to be popped apart and separated, thereby physically separating one of the pin parts of the terminal pin from the other pin part and the body of the terminal, such separation of the parts serving to prevent continuous arcing and to exhaust the built-up capsule pressure, thereby cutting off current flow without destroying the integrity of the hermetic seal.

In accordance with the aforesaid invention, either the inner or the outer pin part may be separated from the remainder of the terminal, although preferably the terminal will be constructed so that the outer pin part will separate, thereby giving a visual indication that there has been a major fault condition. To ensure the desired separation of the pin parts, the capsule is preferably formed in two parts, the first comprising a cup-like body adapted to receive one of the pin parts, the body being closed by a cap adapted to make snap-lock connection with the body, the cap engaging the other pin part. When pressure builds up in the capsule due to fuse vaporization, the path of least resistance is through the cap and the areas of the sealing member surrounding the cap, which effectively blows-away the cap, the adjacent pin part and the surrounding areas of the sealing member.

The terminal construction described above may be utilized with either "soft-seal" terminals wherein the terminal pins are mounted to the terminal body by means of a dielectric material which is molded in situ to the body and pins, or utilizing "hard seal" techniques wherein the pins are mounted in the terminal body by means of glass-to-metal or ceramic-to-metal seals. Where "hard seals" are utilized, at least one side of the terminal body, including the fuse links and the protective capsules, will be encased in a molded in situ dielectric sealing material.

The present invention relates to a modification of the foregoing terminal construction wherein, while permitting release of the pressures generated when the fuse link is vaporized, the integrity of the terminal will be maintained while at the same time the terminal is rendered inoperative and incapable of reuse.

SUMMARY OF THE INVENTION

In accordance with the present invention, the terminal pins are formed by inner and outer pin parts interconnected by a high-temperature fuse link which will melt and/or vaporize when heated to a predetermined temperature, the fuse link and the adjacent ends of the inner and outer terminal pins being surrounded by a protective capsule which provides an air space surrounding the fuse link into which the melted or vaporized fuse link material will migrate, thereby assuring clean separation of the pin parts. However, rather than having the capsule designed to pop apart and separate, thereby separating the adjoining pin part from the remainder of the terminal, the capsule is provided with a blow-out plug which is arranged to separate from the capsule upon the build-up of pressure within the capsule, the blow-out plug being positioned so that it will be propelled outwardly through the portion of the surrounding sealing member overlying the plug, thereby venting the capsule to the atmosphere. With such arrangement the capsule is effectively vented and the melted residue of the fuse link discharged without physically blowing away the terminal pin and the surrounding portion of the sealing member secured to the pin. To this end, the terminal remains intact, yet is effectively rendered inoperative.

The capsule itself is, as before, preferably formed in two parts, the first comprising a cup-like body adapted to receive one of the pin parts, the body being closed at its opposite end by a cap adapted to engage the other of the pin parts and make snap-lock connection with the body of the capsule. Intermediate its opposite ends the cup-shaped body will be drilled to provide a vent port into which a blow-out plug is press fitted, the plug preferably being formed from a high temperature plastic and may comprise the same material from which the capsule is formed. Preferably the blow-out plug will have an annular body of a size to be snugly received in the vent port in the capsule, the plug having an enlarged head adapted to seat on the outer surface of the capsule in the area immediately surrounding the vent port.

In assembling the terminal the blow-out plug will be positioned to face outwardly relative to the surrounding sealing member or insulator, with a thin layer of the sealing member overlying and covering the head of the blow-out plug. The blow-out plug is thus protected against accidental removal and there is no external indication of its presence. However, when a major fault occurs and the fuse link melts within the capsule, the path of least resistance for the built-up pressure in the capsule will be through the blow-out plug and the thin layer of sealing member overlying the head of the plug, the plug being propelled outwardly through the wall of the sealing member, thereby venting the capsule. The disintegration of the fuse link effectively cuts off current flow through the terminal pin without severing the pin from the terminal. At the same time, a visual indication of terminal failure is provided where the blow-out plug is located on the outer side of the terminal. The present invention thus provides for positive separation of the pin parts without physically removing the pin parts.

DESCRIPTION OF THE PREFERRED EMBODIMENTS

Figure 1:
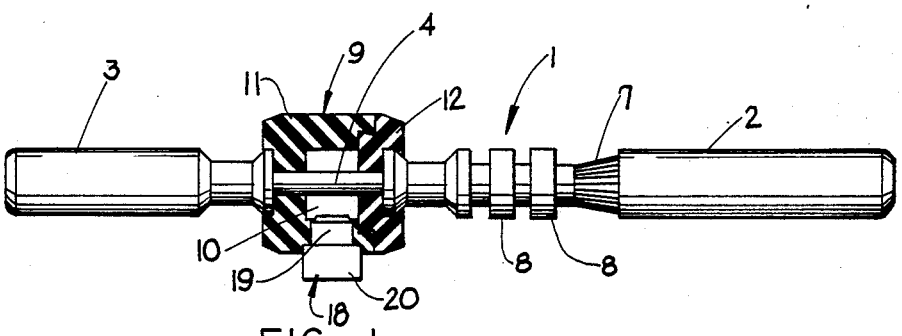
FIG. 1 is a plan view with parts in section of a terminal pin assembly in accordance with the invention.
Figure 2:
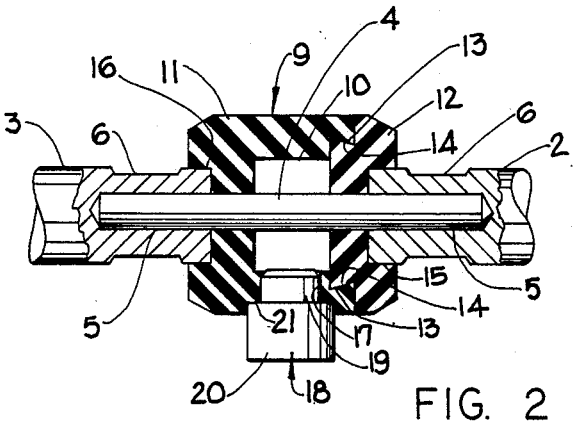
FIG. 2 is an enlarged fragmentary plan view of the center portion of the terminal pin assembly.

As seen in FIG. 1, the terminal pin assembly, indicated generally at 1, comprises a first or inner pin part 2 and a second or outer pin part 3 interconnected by a fuse link 4. Preferably, the pin parts 2 and 3 will be formed from a copper alloy, whereas the fuse link will be formed from a silver alloy. In the embodiment illustrated, and as best seen in FIG. 2, the fuse link 4 is cylindrical and is adapted to have its opposite ends received in axial bores 5 in the pin parts 2 and 3, with the inner ends of the pin parts crimped about the ends of the fuse link, as indicated at 6, thereby ensuring positive electrical contact between the pin parts and the fuse link. The fuse link need not be cylindrical, but rather may be formed as a flat strip or of other configuration, such as a rectangular bar. To this end, the bores 5 in the pin parts can be configured to conform to the configuration of the fuse link, or the opposite ends of the fuse link can be configured to be received in the bores 5.

Preferably, the inner pin part 2 will be provided with a tapered knurled portion 7 (seen in FIG. 1) which will assist in preventing rotation of the pin part, as well as provide an enlarged surface area which will tightly bond to the sealing member in which the terminal pin assembly is mounted. The inner pin part 2 also may be provided with one or more enlarged shoulders 8 which further enhance the surface area of the bond with the sealing member and additionally serve to resist contraction of the sealing material during curing.

In accordance with the invention, the terminal pin assembly incorporates a protective capsule, indicated generally at 9, which surrounds the fuse link 4, the capsule extending between and seating against the inner ends of the pin parts 2 and 3, the capsule including an air space 10 surrounding the central portion of the fuse link 4. The air space is important in that it provides a cavity in which the fuse link material may migrate when it melts or is vaporized by current-induced high temperatures, thus cutting off current flow.

The protective capsule 9 is preferably formed in two parts which, as best seen in FIG. 2, comprise a cup-like body 11 and a cap 12 adapted to be snap-fitted to the open end of the cup-like body 11. To this end, the body 11 and cap 12 are provided with mating undercut shoulders 13 and 14 which provide an interlock. Preferably, the body and cap will be formed from a high temperature plastic material, such as 6—6 Nylon or Polycarbonate, which is sufficiently strong to prevent collapse during the molding of the conductor pin assemblies to the terminal body. Preferably, the inner ends of the pin parts 2 and 3 will seat in mating recesses 15 and 16 formed in the cup-like body 11 and cap 12, respectively.

The body 11 of the capsule is provided with a bore or vent port 17 which receives a blow-out plug, indicated generally at 18, the plug having an annular body 19 of a size to be press-fitted in the port 17 and an enlarged head or cap 20 adapted to seat against the outer surface of the body 11 in the area immediately surrounding port 17. To this end, the body 11 may be provided with a recess 21 in which the head will seat. Preferably, the blow-out plug will be formed from the same material as the capsule, although other materials may be employed.

It will be understood that the terminal pin assembly just described will be pre-assembled to the condition shown in FIG. 1 prior to assembly to the body of the terminal.

Figure 3:
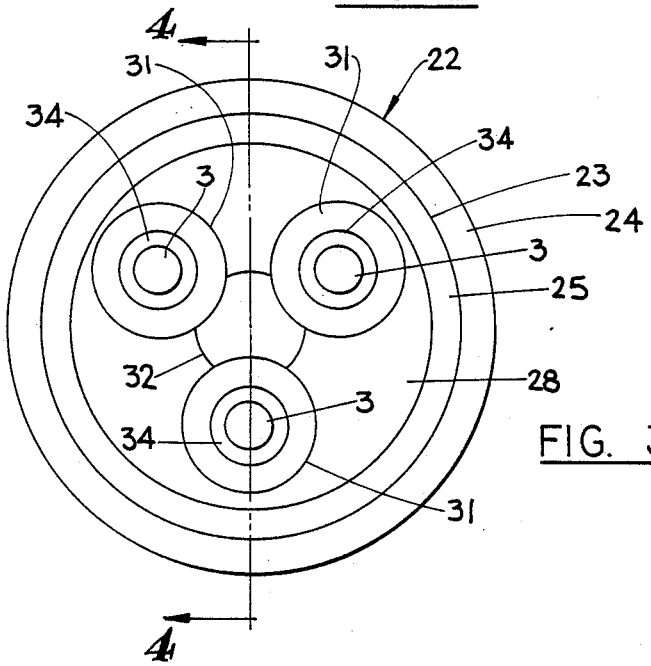
FIG. 3 is a top plan view of a terminal header incorporating the invention.
Figure 4:
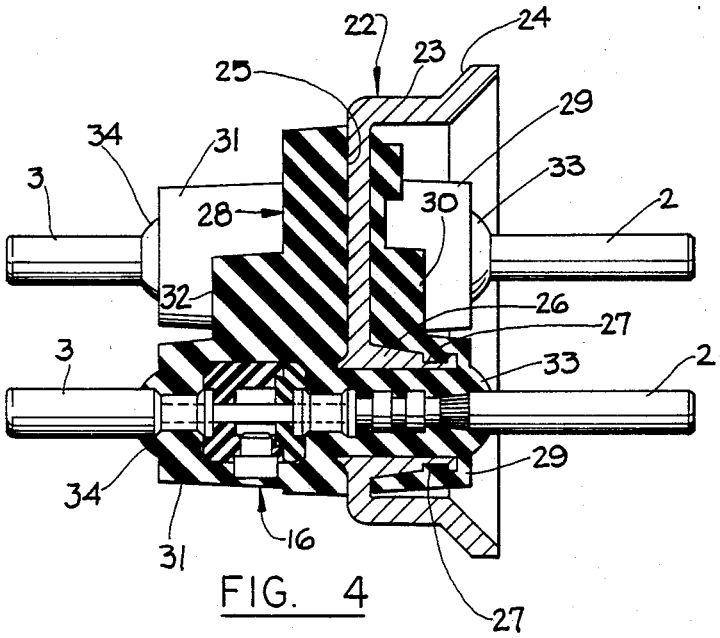
FIG. 4 is a vertical sectional view taken along the line IV—IV of FIG. 3.

Referring next to FIGS. 3 and 4, the terminal body, indicated generally at 22, is of shallow cup-shaped configuration, having an annular body wall 23 terminating at its outermost end in an out-turned mounting flange 24 and at its innermost end in a base 25 interrupted by spaced apart integral sleeves 26 lying within the confines of the annular body wall 23. The configuration of the terminal body 22 is conventional for a three-pin terminal and can be formed of any suitable material, although for most installations a steel body is preferred since it is inexpensive and can be readily formed into the desired shape. The particular material from which the body member is formed is normally determined by the mode of installation of the terminal, depending upon whether it is to be welded, soldered, braised, threaded, press-fitted or adhesively secured in place. The configuration of the sleeves 26 does not constitute a limitation upon the invention, and they may be of cylindrical or tapered configuration, or otherwise configured to effectively increase the area of interface between the sealing material and the terminal body, so as to inhibit the formation of leakage Paths from one side of the terminal to the other due to thermal expansion and contraction of the Parts. To this end, and as shown in FIG. 4, the distal ends of the sleeves 26 may be relieved and flanged, as indicated at 27.

In the embodiment of FIGS. 3 and 4, the terminal pin assemblies 1 are mounted in the sleeves by means of a sealing member or insulator 28 which hermetically seals the terminal pin assemblies to the terminal body 22. The sealing member 28 is preferably formed as a unitary body composed of a dielectric material molded in situ to the desired configuration, the sealing member being bonded to both sides of the base 25.

Various known sealing materials may be used, such as epoxy molding compounds marketed under the trademark EPIALL. On the inner side of the terminal body, the sealing member includes annular enlargements 29 which surround the sleeves 26 and adjacent areas of the inner pin parts 2, together with an enlarged central portion 30 interconnecting the sleeve-surrounding annular enlargements 29. On its outerside, the sealing member 28 is provided with similar annular enlargements 31 which surround the protective capsule 9 and adjoining portions of the outer pin parts 3. The outer side of the sealing member 28 also includes an enlarged central portion 32 which interconnects the annular enlargements 31. If desired, the annular enlargements 29 and 31 may be provided with integral collars 33 and 34 surrounding the inner and outer Pin parts 2 and 3, respectively, at the points where the pin parts emerge from the enlargements, the collars acting to relieve stress concentrations which could result in aging cracks in the peripheral areas of the seals immediately surrounding the pin parts. The collars additionally serve as seats for a plug or other connector for receiving the pin parts. It will be understood that the pin parts may be provided with conventional conductor tabs at one or both ends, as may be required for a particular installation.

Figure 5:
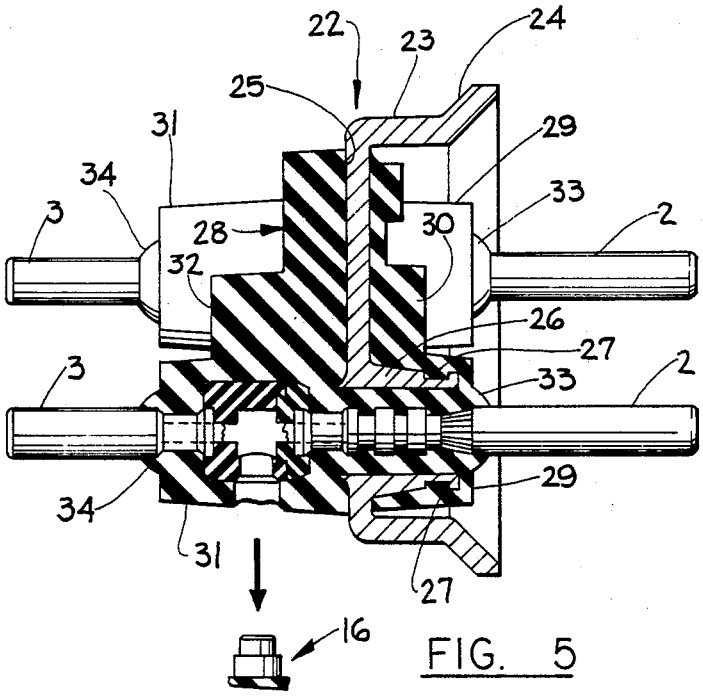
FIG. 5 is a vertical sectional view similar to FIG. 4 illustrating the condition of the parts upon melting of the fuse link and discharge of the blow-out plug.

In the event one or more of the terminal pin assemblies is subjected to a major fault condition, the fuse links 4 for such pins will melt or vaporize in the area of cavity 10 in the protective capsule 9 The vaporization of the fuse material is extremely rapid and extremely high internal pressures will be generated within the capsule 9. In order to relieve this pressure in a manner which will prevent venting of the terminal and yet positively cut off current flow, the pressure generated in the cavity 9 will cause the plug 16 to be blown outward, carrying with it the overlying portion of the surrounding annular enlargement 31 This action is illustrated in FIG. 5. To this end, the portion of the seating member overlying the plug 16 will be relatively thin, as for example, approximately 0.015–0.025 inch, the plug and the overlying portion of the sealing member providing the path of least resistance for the escape of the pressure built-up in the capsule 9. In this connection, it will be seen from FIGS. 4 and 5 that the capsule 9 is surrounded by the much thicker areas of enlargement 31 except in the area of plug 16. It is also preferred that the cap 12 of the capsule face inwardly toward the base 25 of the terminal body which further assures that the plug 16 will provide the path of least resistance for the pressure generated in capsule 9. Thus, while effectively severing the connection between the inner and outer pin parts and relieving the built-up pressure in the capsule, the terminal nonetheless maintains its integrity in that a blow-out of the sealing material within the sleeves 26 is prevented.

Figure 6:
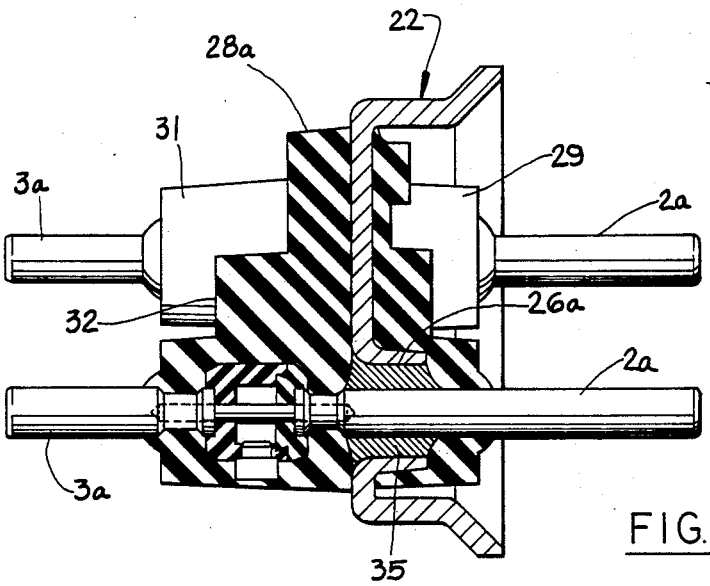
FIG. 6 is a side elevational view of a terminal utilizing glass-to-metal seals.

Referring next to FIG. 6, which illustrates an alternative embodiment of the invention utilizing glass to metal seals, and wherein like parts have been given like reference numerals, the inner pin parts 2*a* will comprise steel pins, such as high conductivity copper core steel pins, which are necessitated by the fact that their coefficient of expansion is compatible with the glass seals 35 utilized to secure the inner pin parts 2*a* to the sleeves 26*a* in the terminal body 22. In this embodiment, the inner pin parts 2*a* are first sealed to the terminal body 22 by means of the seals 35, whereupon the terminal pin assemblies are then completed by the attachment of the fuse links 4, the protective capsules 9 and the outer pin parts 3*a*. When the terminal pin assemblies are completed, the sealing member 28*a* is molded in situ to the terminal body 22, thereby completing the terminal. Since the inner Pin Parts 2*a* are sealed to the terminal body 22 by the glass seals 35, it is necessary to fill the mold for the sealing member 28*a* from both sides of the terminal body. It may be noted, however, that it is not absolutely necessary to have the sealing member 28*a* cover the inner side of the terminal body since the terminal is already sealed with glass. However, it is preferred to include the internal portion of the sealing member since it significantly increases the over-surface path to ground and requires much more internal contamination before arcing can occur.

In use, the terminal of FIG. 6 will perform in the same manner as the embodiment shown in FIGS. 1–5, the parts separating in the same manner as illustrated in FIG. 5 when one or more of the pin assemblies is subjected to fault conditions.

Figure 7:
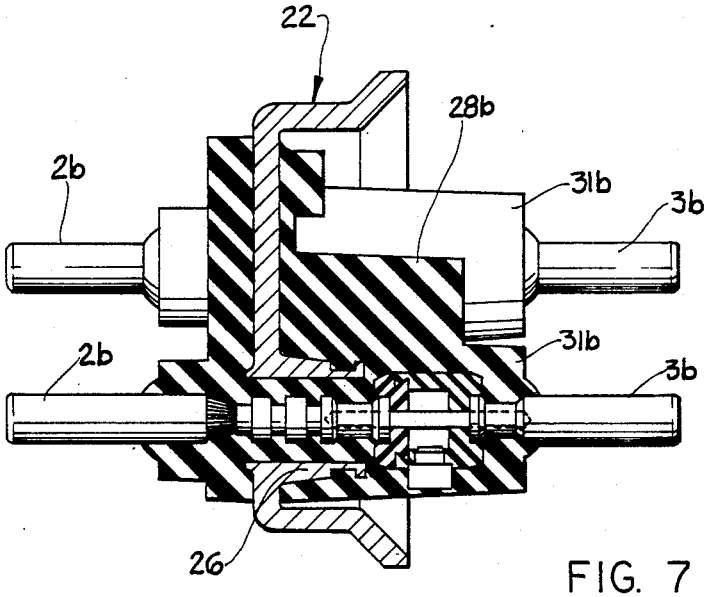
FIG. 7 is a vertical sectional view similar to FIG. 4 illustrating a terminal in which the terminal pin assembly is reversed so that the blow-out plug lies inside the terminal.

As seen in FIG. 7, the position of the terminal assemblies may be reversed so as to locate the fuse link 4 and capsule 9 on the inside of the terminal body 22, in which event the outer pin parts 3 become the inner pin part 3*b* and the inner pin Parts 2 become the outer pin parts 2*b*. Similarly, the position of the sealing member 28*b* will be reversed so that the enlargements 31*b* will surround the protective capsules 9. While in this instance the blow out plug 16 will separate on the inner side of the terminal body, the annular enlargement 31*b* will fracture in the same manner as shown in FIG. 5, thereby maintaining the integrity of the hermetic seals in the areas of the sleeves 26 while breaking the circuit between the pin parts 2*b* and 3*b*.

Figure 8:
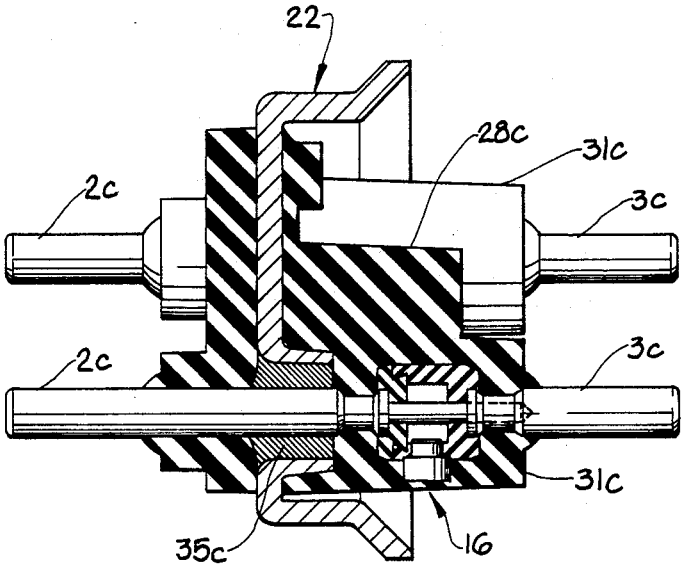
FIG. 8 is a vertical sectional view similar to FIG. 7 showing a reversed terminal pin assembly with a glass-to-metal seal.

In like manner, and as seen in FIG. 8, the construction of the glass-to-metal hermetically sealed terminal of FIG. 6 may be reversed, in which event the inner pin parts 2*a* become the outer pin parts 2*c* and the outer pin parts 3*a* become the inner pin parts 3*c*. In this instance, the outer pin parts 2*c* will be first sealed to the body 22 by the glass or ceramic seals 35*c*, whereupon the fuse links 4 and inner pin parts 3*c* on the inner side of the terminal body will be assembled and the sealing member 28*c* molded in situ with the enlargements 31*c* surrounding the capsules 9 and adjacent portions of the pin parts 3*c*.

As should now be evident, the instant invention provides hermetically sealed terminals which have been found to effectively eliminate the blow-out problems which have hitherto been encountered with both glass seal and so-called soft seal terminals when subjected to major fault conditions.

What is claimed is:

1. An hermetically sealed terminal construction comprising:

a terminal body comprising a base having inner and outer sides and at least one annular opening therein defined by a sleeve projecting outwardly from the inner side of said base, a terminal pin assembly adapted to be mounted on said base, said terminal pin assembly comprising a pair of pin parts lying in axially spaced relation to each other, a fuse link interconnecting the inner ends of said pair of pin parts, a protective capsule surrounding said fuse link and engaging the inner ends of said pin parts, said capsule defining an expansion cavity surrounding said fuse link, a vent port in said capsule, and a blow-out plug closing said port, said blow-out plug being adapted to be expelled outwardly from said vent port upon the build-up of pressure in said cavity caused by current induced disintegration of said fuse link, and sealing means securing said terminal pin assembly to said terminal body, with a first of said pin parts extending centrally through said sleeve, and the other of said pin parts and said capsule projecting beyond said sleeve, a first component of said sealing means lying within said sleeve and providing an hermetic seal between said first pin part and said terminal body, a second component of said sealing means comprising a sealing member covering at least one side of said terminal body and surrounding and covering said protective capsule, said blow-out plug and contiguous portions of the other of said pin parts, said sealing member being adapted to be ruptured by said blow-out plug as it is expelled from the port in said capsule to discharge the pressure built-up in said capsule upon disintegration of said fuse link while maintaining the hermetic seal between said first pin part and said terminal body.

2. The hermetically sealed terminal construction claimed in claim 1 wherein the first component of said sealing member comprises a glass-to-metal seal, and wherein said second component comprises a molded dielectric sealing member.

3. The hermetically sealed terminal construction claimed in claim 1 wherein said first component of said sealing means comprises a molded dielectric sealing material integral with said second component.

4. The hermetically sealed terminal construction claimed in either of claims 2 or 3 wherein said sealing means includes a third component comprising a molded dielectric sealing member covering the remaining said of said terminal body and adjacent portions of said first pin part.

5. The hermetically sealed terminal claimed in claim 1 wherein said protective capsule has an annular wall, wherein said vent port is formed in said annular wall, and wherein said blow-out plug has an enlarged head seated against the outer surface of said annular wall in an area immediately surrounding said vent port.

6. The hermetically sealed terminal construction claimed in claim 5 wherein said protective capsule comprises a cup-shaped body defining said annular wall, said cup-shaped body having a removable cap at one end thereof.

7. The hermetically sealed terminal construction claimed in claim 6 wherein said cup-shaped body and said removable cap have mating undercut shoulders, whereby said cap is snap-fitted to said body.

8. The hermetically sealed terminal construction claimed in claim 5 wherein said protective capsule is formed from a plastic material, and wherein the walls of said capsule are sufficiently rigid to resist collapse during formation of said surrounding sealing member.

9. The hermetically sealed terminal construction claimed in claim 8 wherein said protective capsule has a recess in its outer surface surrounded said vent port in which the enlarged head of said blow-out plug is adapted to be seated.

10. The hermetically sealed terminal construction claimed in claim 1 wherein the inner ends of said pin parts have axial bores therein sized to receive the opposite ends of said fuse link, and wherein the inner ends of said pin parts are crimped about the opposite ends of said fuse link.

11. The hermetically sealed terminal construction claimed in claim 10 wherein said protective capsule has recesses in its opposite ends adapted to receive the inner ends of said pin parts.

12. The hermetically sealed terminal construction claimed in claim 1 wherein said sealing member has an annular enlargement surrounding said protective capsule and the contiguous portion of said other pin part, and includes an integral collar at the outer end of said annular enlargement.

13. The hermetically sealed terminal claimed in claim 12 wherein said sealing means includes a sealing member component covering the remaining side of said terminal body, said sealing number component having an annular enlargement surrounding a portion of said first pin part, including an integral collar at the outer end of said last named annular enlargement.

14. The hermetically sealed terminal construction claimed in claim 1 wherein said terminal body has a plurality of sleeves therein, and wherein a terminal pin assembly is mounted in each of said sleeves.

15. A terminal pin assembly for use in an hermetically sealed terminal, said assembly comprising:

a first pin part, a second pin part lying in axially spaced relation to said first pin part, a fuse link interconnecting said first and second pin parts, and a protective capsule surrounding said fuse link and engaging the adjoining ends of said first and second pin parts, the surrounding walls of said capsule being spaced from said fuse link to define an expansion chamber, a vent port in a wall of said capsule, a blow-out plug in said vent port, said blow out plug being adapted to be expelled outwardly from said capsule upon the build-up of pressure in said expansion chamber caused by rapid disintegration of said fuse link.

16. The terminal pin assembly claimed in claim 15 wherein said blow-out pug has an enlarged head at its end.

17. The terminal pin assembly claimed in claim 16 wherein said protected capsule comprises a cup shaped body having a removable cap at one end thereof.

18. The terminal pin assembly claimed in claim 17 wherein said protective capsule is formed from a plastic material, and wherein said blow-out plug is formed from a plastic material.

* * * * *